US010737750B2

(12) United States Patent
Lundstedt, Jr.

(10) Patent No.: US 10,737,750 B2
(45) Date of Patent: Aug. 11, 2020

(54) RAIL SAVER WITH HANDLE

(71) Applicant: Roy L. Lundstedt, Jr., Carlsbad, CA (US)

(72) Inventor: Roy L. Lundstedt, Jr., Carlsbad, CA (US)

( * ) Notice: Subject to any disclaimer, the term of this patent is extended or adjusted under 35 U.S.C. 154(b) by 0 days.

(21) Appl. No.: 16/382,677

(22) Filed: Apr. 12, 2019

(65) Prior Publication Data

US 2019/0351980 A1 Nov. 21, 2019

Related U.S. Application Data

(60) Provisional application No. 62/673,124, filed on May 18, 2018.

(51) Int. Cl.
*B63H 8/54* (2020.01)
*B63B 32/70* (2020.01)
*B63B 32/73* (2020.01)

(52) U.S. Cl.
CPC ..... *B63H 8/54* (2020.02); *B63B 32/70* (2020.02); *B63B 32/73* (2020.02)

(58) Field of Classification Search
CPC ..... B63B 35/00; B63B 35/79; B63B 35/7933; B63B 35/7993; B63B 32/70; B63B 32/73; B63H 8/54
USPC ..... 114/39.18; 441/75
See application file for complete search history.

(56) References Cited

U.S. PATENT DOCUMENTS

| | | | | |
|---|---|---|---|---|
| 4,044,415 | A * | 8/1977 | Wood | B63B 32/70 441/75 |
| 4,610,634 | A * | 9/1986 | Kimura | B63B 32/70 441/75 |
| 5,098,324 | A * | 3/1992 | Isono | B63B 32/70 441/75 |
| 6,471,560 | B2 * | 10/2002 | Kerckhoff | B63B 32/70 441/75 |
| 8,894,457 | B1 * | 11/2014 | Crozier | B63B 32/70 441/75 |
| 2009/0117792 | A1 * | 5/2009 | Buche | B63B 32/00 441/75 |
| 2012/0244763 | A1 * | 9/2012 | Cregan | B63B 32/45 441/75 |
| 2014/0357140 | A1 * | 12/2014 | Falken | B63B 32/70 441/75 |

* cited by examiner

*Primary Examiner* — Lars A Olson
(74) *Attorney, Agent, or Firm* — Eric Hanscom

(57) ABSTRACT

The invention is directed toward a "Rail saver with a handle. The rail saver has a handle the extends laterally away from the rail saver, creating a "loop" which the user can grab to maintain control over a water sports vehicle such as a long board, SUP, foil board, sail board, body board and other water sports vehicles. The "rail saver with a handle" is designed to add the functionality of being able to grab and control a free-floating board while in water. Grabbing and controlling an SUP board is also difficult while holding a paddle. This new functionality provides an opportunity to control a board with one hand whether or not you are holding a paddle. By holding and using the handle, the board rider avoids injury to his fingers or hands from grasping at a leash cord that is not designed to be grabbed.

17 Claims, 4 Drawing Sheets

RAIL SAVER WITH HANDLE

CROSS REFERENCE TO RELATED APPLICATIONS

This application claims priority to U.S. Provisional Application No. 67/673,124 dated May 18, 2018, the contents of which are incorporated by reference into this application.

STATEMENT REGARDING FEDERALLY SPONSORED RESEARCH OR DEVELOPMENT

This invention was not federally sponsored.

BACKGROUND OF THE INVENTION

This invention relates to the general field of watersports equipment, and more specifically to a rail saver with a handle, which allows a water sports participant to grab and control an SUP, surfboard, longboard, body board or other water sports vehicles through a conveniently located handle. It is basically a "rail saver with a handle", where it functions as a handle for any water sport leash that may or may not incorporate a rail saver as an attachment mechanism of a leash to surfboards, long boards, paddle boards, foil boards, sail boards, body boards and/or any other watersports vehicle, requiring the use of a leash. In instances where a rail saver is not inherently part of the existing leash, as in a body board leash, the addition of a rail saver handle to the leash creates the control intended by this invention. Presently, surfboards, long boards, paddle boards, foil boards, sail boards, body boards and/or any other watersports vehicles do not generally include a built-in handle to grasp and/or hold on to. In addition, there are no leashes for such watersport vehicles that incorporate a handle.

BACKGROUND OF THE INVENTION

Surfboard leashes are utilized as means to connect surfers, long boarders, paddle boarders, foil boarders, sail boarders, body boarders and/or any other watersports vehicle users to their boards in a reliable manner with minimal drag. The main advantage of using a leash is that board riders don't easily get separated from their boards, thus alleviating the need to swim in order to recover their board after a wipeout or falling from their board. If a board rider should become separated from a board, they could have to swim a considerable distance in order to recover theft board and risk fatigue or drowning. An additional advantage of using a board leash is that the board won't easily become dislodged and collide with other board riders or swimmers causing damage or injury to either the boards, swimmers or the board riders themselves, Surf leashes incorporate a cuff for attaching a limb of a surfer, a leash cord and a mechanism for attaching the leash to a board. The connection mechanism for the leash cord to the surfboard is commonly called the rail saver. The rail saver's function is two-fold, to protect the rails (edges) of a board that come in contact with the leash from being damaged from the pressure of the leash cord and to also connect the leash to the board and to the rider. While riding waves in the ocean or white water in rivers the force of moving water pushes the board away from the riders and makes it difficult to hold on to or grasp the board until calmer water is found. Riders may also find themselves being pulled under water when separated from theft board and away from the buoyancy benefits of theft boards. Some boards, such as body boards, do not inherently include a rail saver, but could benefit from control provided by a rail saver handle.

Improvements are needed for allowing water sports participants to have greater control over their boards when they fall off. This is particularly noticeable in the highly variable water conditions encountered while surfing or river running. There have been many instances of injury to fingers and hands when a board rider has attempted to control a board by grabbing onto a standard water sport leash. Presently, surfboards, long boards, paddle boards, foil boards, sail boards, body boards and/or any other watersports vehicles do not generally include a built-in handle to grasp and/or hold on to, and currently marketed leashes for such waterspouts vehicles do not include a handle. Instructors of surf lessons, SUP lessons and other waterboard sports can also benefit from the opportunity to control their students' boards with a rail saver handle.

Thus, a need exists for a leash that incorporates a "rail saver with a handle" to provide an aspect of control of the board and also providing safety in variable water conditions, by enabling board riders to easily grab and hold onto theft boards.

The current invention provides just such a solution by providing a product which is a "rail saver with a handle" attached to a leash and is used to grab, hold and control surf boards, long boards, paddle boards, foil boards, sail boards, body boards other water sports vehicles while in the water.

The "rail saver with handle" may be constructed out of nylon or polyester but is not limited to these materials. The handle may have a protective cover made of plastic, neoprene or other material, for increased comfort and/or to facilitate the grip of the handle. The handle aspect of the "Rail saver with handle" is connected to the rail saver in a location near the junction of the leash cord as well as connected at the board end of the rail saver, near the junction of the nylon rope that connects the rail saver to the board. The size of the handle is designed to bow out to allow the board rider's hand to easily grab and fit into the handle. The handle design does not impede the attachment of a leash to a board and may vary in size.

This Summary is provided to introduce a selection of concepts in a simplified form that are further described below in the Detailed Description. This Summary is not intended to identify key features or essential features of the claimed subject matter, nor is it limited to be used as an aid in determining the scope of the claimed subject matter.

OBJECTS OF THE INVENTION

It is therefore an object of the present invention to provide a means by which a user of a water sport vehicle can maintain control over the vehicle in variable water conditions, when the rider is off the board.

The presented invention ("Rail saver with handle") relates to leashes used for surfboards or other similar devices such as long boards, paddle boards, foil boards, sail boards, body boards other water sports vehicles and more particularly relates to the rail saver aspect of a surfboard leash. Surf leashes incorporate a cuff for attaching a limb of a surfer, a leash cord and a mechanism for attaching the leash to a board. The connection mechanism for the leash cord to the surfboard, paddle board, foil board, sail board, body boards and/or any other watersports vehicle is commonly called the rail saver. The rail saver's function is two-fold, to protect the rails of a board that come in contact with the leash from being damaged from the pressure of the leash cord and to also connect the leash to the board and the rider. In instances where a rail saver is not inherently part of the existing leash, as in a body board leash, the addition of the rail saver handle to the leash creates the control intended by this invention.

The "rail saver with a handle" is designed to add the functionality of being able to grab and control a free-floating board while in water. Grabbing and controlling a board is also difficult while holding a paddle, as in the sport of Stand Up Paddle (SUP) surfing or boarding. This new functionality provides an opportunity to control a board with one hand whether or not you are holding a paddle. The "rail saver with handle" may be constructed out of nylon or polyester but is not limited to these materials. Handle may have a protective cover made of plastic, neoprene or other material, for increased comfort and/or to facilitate the grip on the handle. The handle aspect of the "Rail saver with handle" is connected to the rail saver in a location near the junction of the leash cord as well as connected at the board end of the rail saver, near the junction of the nylon rope that connects the rail saver to the board. The size of the handle is designed to bow out to allow the board rider's hand to easily grab and fit his/her hand into the handle.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
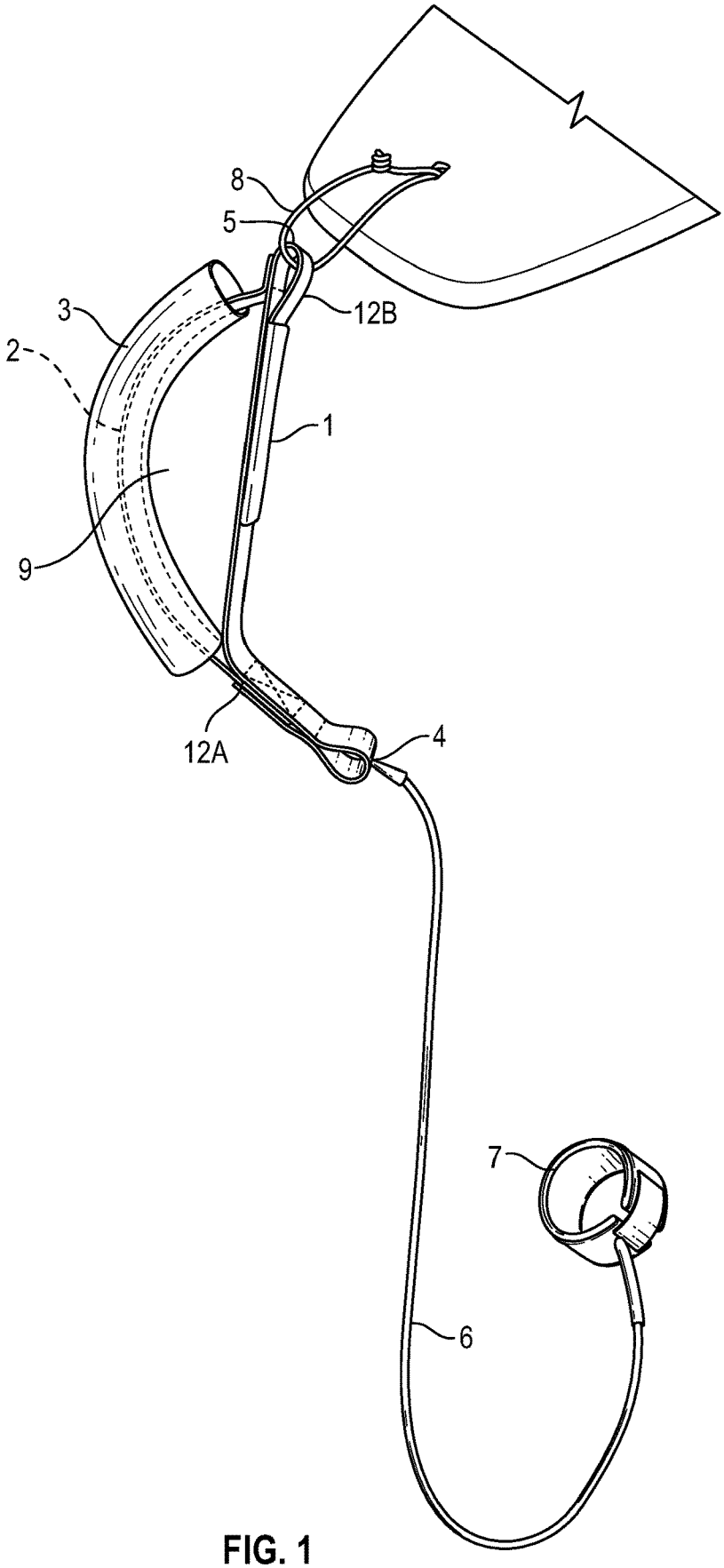
FIG. 1 is a simplified view illustrating the "rail saver with handle" on a common board leash.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Leashes are used to tether surfboards, paddle boards, foil boards, sail boards, body boards and/or any other watersports vehicle to a board rider's ankle, calf, waist or wrist. The leash can keep the board within reach of the user when the user falls off the board while on the water. While in highly variable water conditions it may sometimes be tough to climb back onto a board. During these variable water conditions, the ability to grab, hold on to and control the board through a handle may be needed for the safety of the rider and other boarders nearby. Most surfboards, long boards, paddle boards, foil boards, sail boards, body boards and/or any other watersports vehicles do not come with a built-in handle to grasp and/or hold on to, and no leashes for these watersport vehicles includes a handle. Further, the provision of a handle can serve to prevent injury that can be incurred by attempting to grab a slippery leash, which can harm fingers or hands.

Recently Standup Paddle (SUP) surfing, SUP paddling, SUP fishing, foil boarding and other watersports paddling have exploded in popularity. Although these watersports borrow many traits from other sports such as surfing, longboarding and body boarding, these new sports present some unique control and safety challenges. First, like other water sports, SUP surfers and paddlers frequently paddle through or get stuck in crashing surf. The larger more buoyant SUP boards are easily moved by wave action and are sometimes difficult to control. With a typical SUP board measuring 10-12 feet long, and a leash 10 feet long, the rider has about a 20-foot radius of potential contact with others in the water. If not controlled in these situations, these larger boards can be dislodged from the leash and lost in the waves and/or become a hazard to other boarders or swimmers. Second, the emerging sport of hydrofoil surfing and hydrofoil SUP surfing utilizes a foil board with a significantly larger fin system. Control of the foil board is essential in variable water conditions to avoid endangering the foil boarder or other nearby board riders. Third, surfers, long boarders and big wave surfers are faced with similar board control challenges in highly variable water conditions. Wave action can pull the boarder under water and away from their board. The ability to hold on to theft board in variable wave action provides a level of floatation safety.

FIG. 1 is a simplified view illustrating the "rail saver with handle" on a common board leash for use with surfboards, paddle boards, foil boards, sail boards, body boards and/or any other watersports vehicle, requiring the use of a leash. Rail saver 1 is illustrated with Handle 2 attached to it. The length of material used to create the handle 2 is longer than the length of material of the Handle Base, which is defined as the section between 12A and 12B, the Handle Base connection points, thereby creating the loop 9. A protective neoprene tube cover 3 is shown; with handle 2 threaded through it, and is designed to maintain an open position (loop 9) in order to be easily grasped while in variable water conditions. Handle 2 is attached to rail saver 1 near the junction of the leash cord 4 and the opposite end of the rail saver 1 that attaches to the board end 5 of the rail saver. A nylon, or similar material, rope 8, is held by the fold created at point 5 and enables the attachment of the rail saver and leash to a board. Leash cord 6 and the cuff 7 that is used to attach to the board rider to the leash are illustrated.

Figure 2:
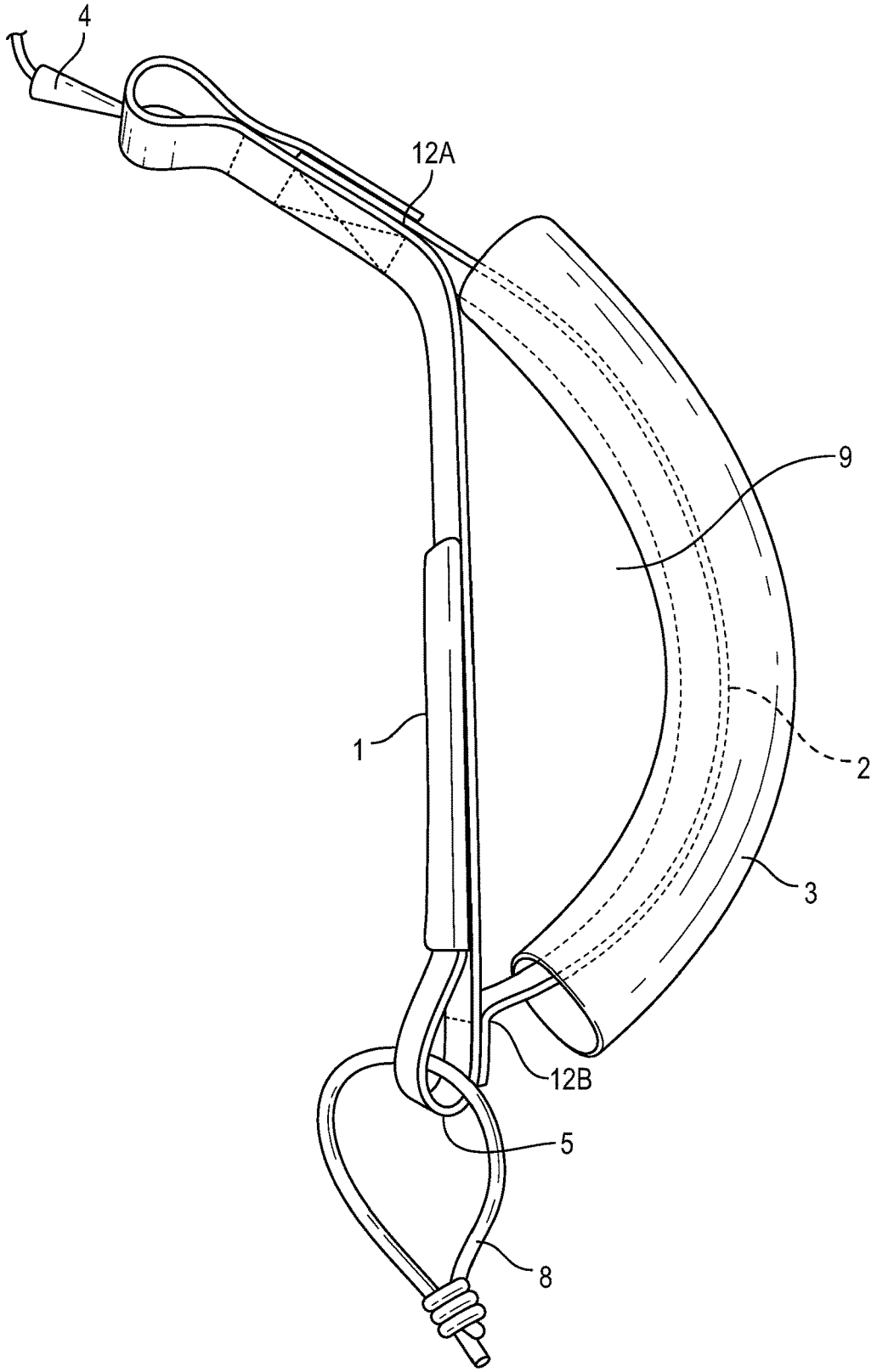
FIG. 2 is a close-up view of the handle/rail saver portion of the invention.

FIG. 2 is a close-up view of the handle/rail saver portion of the invention. Loop 9 is a convenient handle by which a user can hold and maneuver an SUP, surfboard or other water vehicle. Loop 9 is formed by sewing handle 2 onto rail saver 1. Because handle 2 is longer in length that the section of the Handle Base upon which it is sewn, where the Handle Base is defined as the section between 12A and 12B, the Handle Base connection points, the loop 9 is formed. Protective cover 3 covers handle 2 to give a user a more gentle surface to grab. The rail saver 1 folds back on itself at board end of rail saver 5 and is secured through hook and loop. This creates the fold at board end 5 where the nylon rope 8 is held, to be removably attached to a water sports vehicle.

Figure 3:
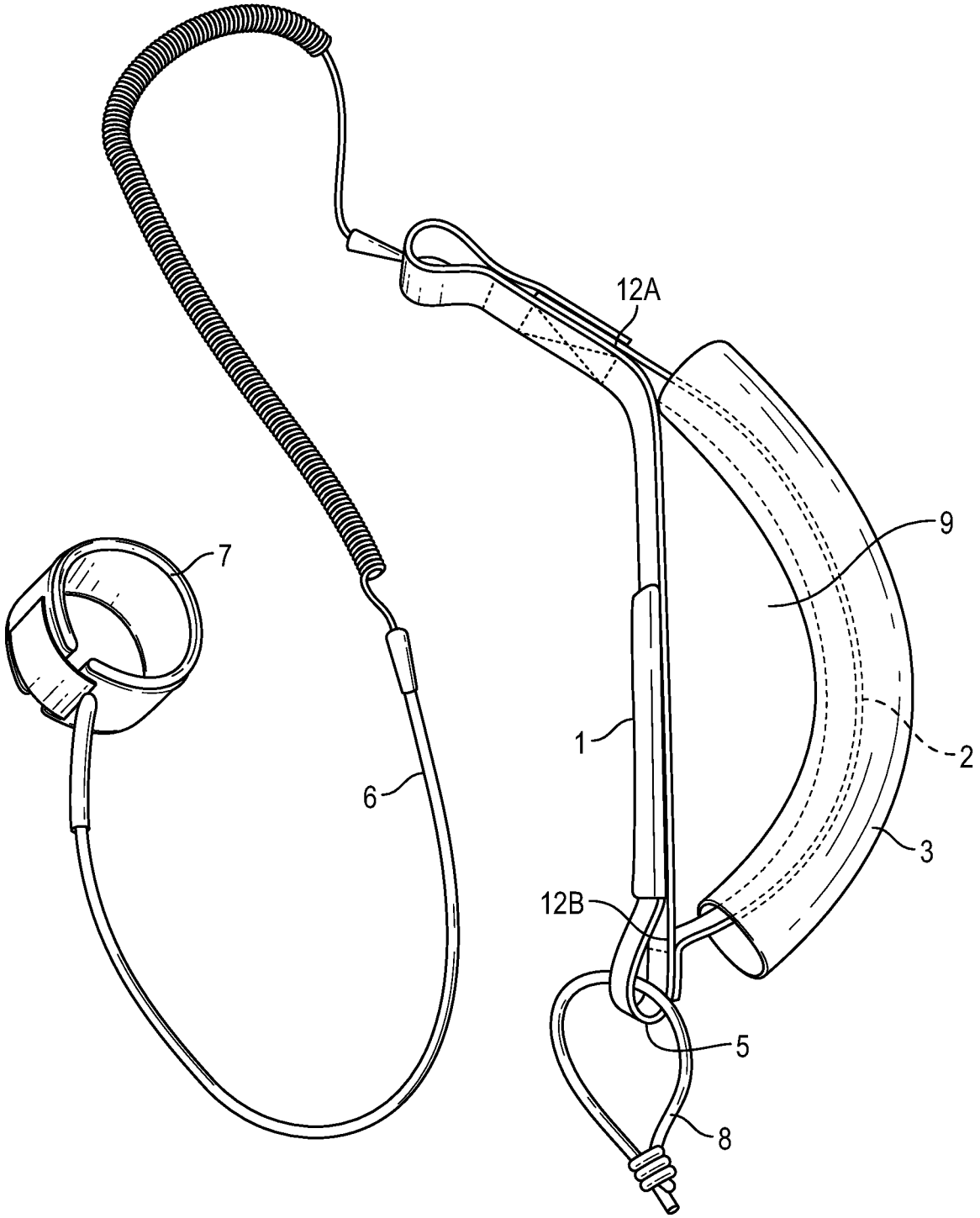
FIG. 3 is a side, perspective view of a "coil leash cord" embodiment of the invention.

FIG. 3 is a side, perspective view of a "straight leash cord" embodiment of the invention. As opposed to the version illustrated in FIG. 1, which had a straight leash cord 6, in this embodiment, leash cord 6 has a straight section leading away from the cuff, which serves to keep the leash from getting tangled in the feet of the user, and coiled section that prevents the leash from dragging behind the board while it is being paddled or surfed.

Figure 4:
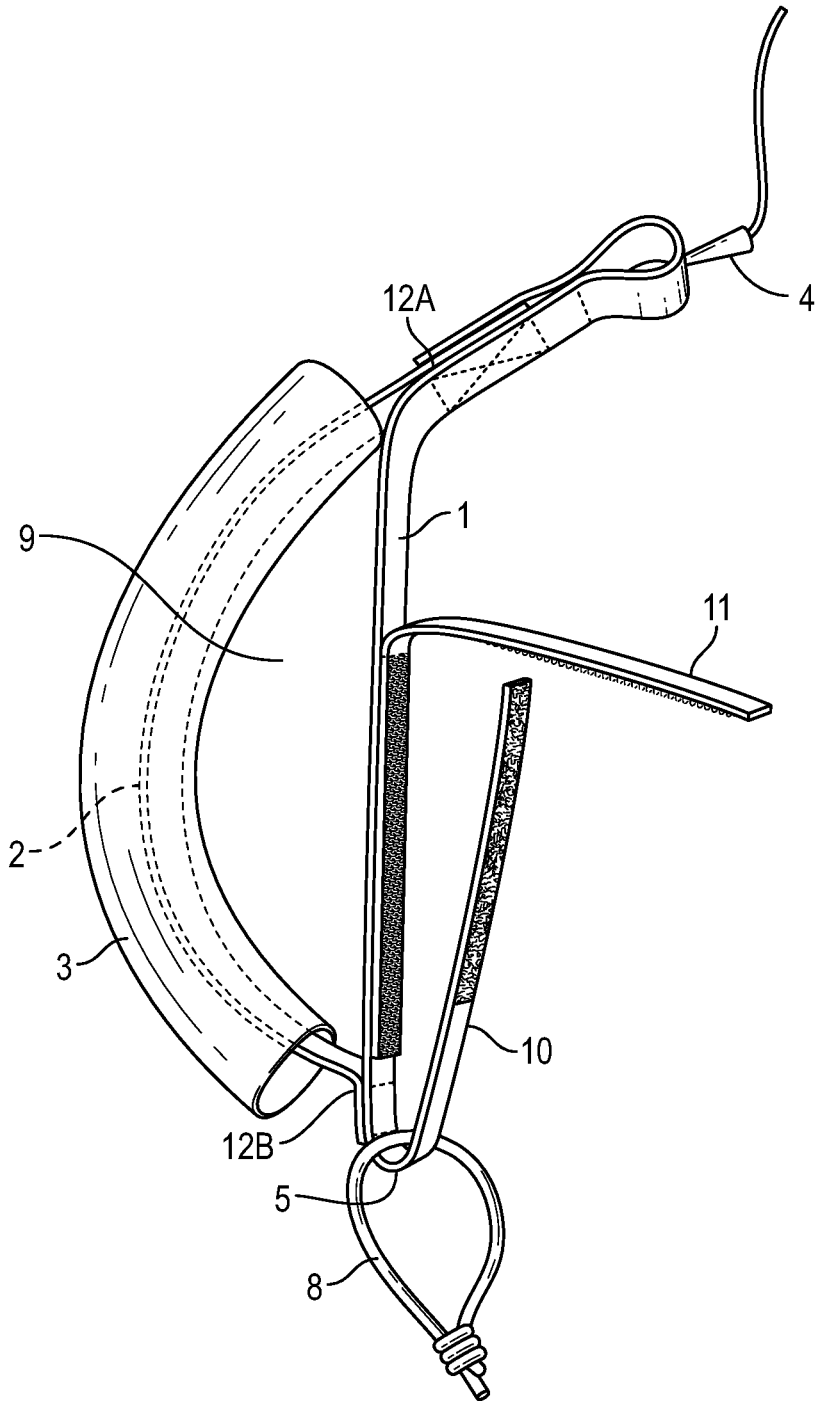
FIG. 4 is a side, perspective view of the hook and loop attachment mechanism by which the invention is attached to the SUP or surfboard.

FIG. 4 is a side, perspective view of the hook and loop attachment mechanism by which the invention is attached to the SUP or surfboard. The hook and loop attachment mechanism work by first inserting an inner portion 10 through the nylon rope 8, and "clamping" the inner portion 10 in between the two halves or an outer portion 11. The inner portion has one of either hook or loop, with the inside surfaces of the outer portion having the corresponding, mating surface such that once the inner portion is clamped in between the two halves of the outer portion, the invention is removably secured to the water sports vehicle through the nylon rope 8.

It is contemplated that the rail saver portion of the invention could be manufactured and sold as an independent unit. A number of types of water sports enthusiasts could benefit from the ability to purchase just the rail saver portion. For example, when a leash breaks at the leash cord-rail saver junction, the rail saver with a handle could replace the broken rail saver. Another group that could benefit from the ability to purchase just the rail saver portion would be surfers who choose to surf without a leash, but would still like the convenience feature of being able to grab the handle and control the surfboard. A final group would be body boarders who would like to add the handle aspect to a leash that came with theft body board.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

REFERENCE NUMBERS USED

1. Rail saver
2. Handle
3. Protective cover
4. Leash cord-rail saver connection
5. Board end of rail saver
6. Leash cord
7. Cuff
8. Nylon rope
9. Loop
10. Inner portion
11. Outer portion
12A. Handle base connection point, leash end
12B. Handle base connection point, board end That which is claimed:

1. A device for maintaining control over a water sports vehicle, comprising a leash portion, a rail saver portion, and a nylon rope, where the leash portion comprises a cuff and a leash cord, where the rail saver portion comprises a rail saver with a handle base, a board end and a leash end, where the rail saver additionally comprises a handle, where the handle comprises a loop and a protective cover, where the cuff fits around a body part of a user, where the leash cord connects to the cuff, where the leash portion and the rail saver portion are connected at a leash cord rail saver connection, where the handle base is connected to the loop at two rail saver loop connections, where the handle base has a handle base length that is defined by a distance between the two rail saver-loop connections, and the handle has a handle length, and where the handle base length is less than the handle length, such that a loop is formed, where the loop extends in an outward direction from the handle base, creating the loop, where the board end of the rail saver comprises an inner portion and an outer portion, where the inner portion has two inner portion outer surfaces and where the two inner portion outer surfaces comprise one of hook or loop, and where the outer portion has two outer portion inner surfaces, and where the two outer portion inner surfaces comprise a mating hook or loop surface which removably mates with the two inner portion surfaces, and where the inner portion in inserted through a nylon rope loop in the nylon rope, and where the two outer portion inner surfaces are attached on two opposite sides of the inner portion to removably secure the device to the nylon rope, and where the nylon rope connects the rail saver portion to a water sports vehicle, such that a user can fit a hand into the loop to control the water sports vehicle.

2. A device for maintaining control over a water sports vehicle, comprising a leash portion, a rail saver portion, and a water vehicle connection device, where the leash portion comprises a cuff and a leash cord, where the rail saver portion comprises a rail saver with a handle base, a board end and a leash end, where the rail saver additionally comprises a handle with a loop, where the cuff fits around a body part of a user, where the leash cord connects to the cuff, where the leash portion and the rail saver portion are connected at a leash cord-rail saver connection, where a nylon rope connects the rail saver portion to a water sports vehicle, such that a user can fit a hand into the loop to control the water sports vehicle.

3. The device of claim 2, where the rail saver additionally comprises a handle, where the handle comprises a loop and a protective cover.

4. The device of claim 3, where the loop is connected to the rail saver at two rail saver-loop connections, forming the handle base between the connections.

5. The device of claim 4, where the handle base has a handle base length and the handle has a handle length, and where the handle base length is less than the handle length, such that a loop is formed, extending in an outward direction from the handle base, creating the loop, where the board end of the rail saver comprises an inner portion and an outer portion, where the inner portion has two inner portion outer surfaces and where the two inner portion outer surfaces comprise one of hook or loop, and where the outer portion has two outer portion inner surfaces, and where the two outer portion inner surfaces comprise a mating hook or loop surface which removably mates with the two inner portion surfaces, and where the inner portion is inserted through a nylon rope loop in the nylon rope, and where the two outer portion inner surfaces are attached on two opposite sides of the inner portion to removably secure the device to the nylon rope.

6. The device of claim 5, where the cover is free floating.

7. The device of claim 5, where the cover is secured to the loop.

8. The device of claim 5, where the cover is secured to the rail saver base.

9. The device of claim 5, where the cover has an inner side with an inner side thickness and an outer side with an outer side thickness, and the inner side thickness is greater than the outer side thickness, thereby protecting a hand inserted into the loop by a user.

10. The device of claim 5, where the water vehicle connection device is a nylon rope.

11. The device of claim 5, where the leash cord-rail saver connection is a swivel.

12. The device of claim 5, where the leash cord-rail saver connection is a tied end.

13. A device for maintaining control over a water sports vehicle, comprising a leash portion, where the leash portion comprises a cuff and a leash cord, and a rail saver portion, where the rail saver portion comprises a handle base and a loop, where a user can insert a hand into the loop to control a water vehicle, where the cuff fits around a body part of a user, where the leash cord connects to the cuff, where the leash portion and the rail saver portion are connected at a leash cord-rail saver connection, where the rail saver portion comprises a rail saver with a handle base, a board end and a leash end, where the rail saver additionally comprises a handle, where the board end of the rail saver comprises an inner portion and an outer portion, where the inner portion has two inner portion outer surfaces and where the two inner portion outer surfaces comprise one of hook or loop, and where the outer portion has two outer portion inner surfaces, and where the two outer portion inner surfaces comprise a mating hook or loop surface which removably mates with the two inner portion surfaces, and where the inner portion is inserted through a nylon rope loop in the nylon rope, and where the two outer portion inner surfaces are attached on two opposite sides of the inner portion to removably secure the device to the nylon rope, where the handle comprises a loop and a protective cover, where the rail saver is connected to the loop at two rail saver-loop connections creating a handle base, where the handle base has a handle base length and the handle has a handle length, and where the handle base length is less than the handle length, such that a loop is formed, extending in an outward direction from the handle base, creating the loop, where the nylon rope connects the rail saver portion to a water sports vehicle, such that a user can fit a hand into the loop to control the water sports vehicle.

14. The device of claim 13, where the leash cord-rail saver connection is a swivel, and the protective cover is a neoprene loop cover, and the device is an SUP leash device.

15. The device of claim 14, where the two rail saver-loop connections are sewn connections, and where the protective cover is free floating.

16. The device of claim 15, where the protective cover is a 3 mm neoprene protective cover.

17. The device of claim 16, additionally comprising a nylon rope, where the nylon rope is attached to the board end of the rail saver and connects the device to a water sport vehicle.

* * * * *